US008074798B2

(12) United States Patent
Williams et al.

(10) Patent No.: US 8,074,798 B2
(45) Date of Patent: Dec. 13, 2011

(54) TOOL TOTE

(75) Inventors: Matthew G. Williams, Lighthouse Point, FL (US); Terrence P. Kinskey, Alpharetta, GA (US)

(73) Assignee: Union Rich USA LLC, Boca Raton, FL (US)

( * ) Notice: Subject to any disclaimer, the term of this patent is extended or adjusted under 35 U.S.C. 154(b) by 168 days.

(21) Appl. No.: 12/137,319

(22) Filed: Jun. 11, 2008

(65) Prior Publication Data

US 2009/0008281 A1 Jan. 8, 2009

Related U.S. Application Data

(60) Provisional application No. 60/943,129, filed on Jun. 11, 2007.

(51) Int. Cl.
*B65D 85/00* (2006.01)
*B65D 30/20* (2006.01)

(52) U.S. Cl. ..... 206/373; 190/127; 190/107

(58) Field of Classification Search ..... 206/372, 206/373, 349; 383/2, 114; 190/107, 127; 220/639, 651–653, 666
See application file for complete search history.

(56) References Cited

U.S. PATENT DOCUMENTS

| | | | | |
|---|---|---|---|---|
| 4,953,673 | A * | 9/1990 | Ambasz | 190/103 |
| 5,086,888 | A * | 2/1992 | Chu | 190/107 |
| 5,090,526 | A * | 2/1992 | Jacober | 190/107 |
| 5,400,906 | A * | 3/1995 | Tang | 206/457 |
| 5,758,974 | A * | 6/1998 | Markowitz | 383/127 |
| 6,443,274 | B1 * | 9/2002 | Klamm | 190/18 A |
| 6,516,751 | B2 * | 2/2003 | Burns et al. | 119/497 |
| 6,604,617 | B2 | 8/2003 | Davis et al. | |
| 7,150,345 | B2 * | 12/2006 | Redzisz | 190/111 |
| 7,451,861 | B2 * | 11/2008 | Bhavnani | 190/107 |
| 2004/0016666 | A1 * | 1/2004 | Redzisz | 206/372 |
| 2006/0037881 | A1 * | 2/2006 | Redzisz et al. | 206/373 |
| 2007/0025647 | A1 | 2/2007 | Hamlin | |

* cited by examiner

*Primary Examiner* — Steven A. Reynolds
(74) *Attorney, Agent, or Firm* — Duane Morris LLP; J. Rodman Steele, Jr.; Gregory M. Lefkowitz

(57) ABSTRACT

A tool tote that is collapsible to reduce storage space is disclosed. The tool tote may be generally rectangular and include an upper opening facilitating access into the main compartment of the tote. The tote may include a removable rigidity enhancement device enabling the tote to be a self supporting tote when fully erected and enabling the tote to be collapsible when the rigidity enhancement device is pivoted out of position.

19 Claims, 10 Drawing Sheets

TOOL TOTE

CROSS REFERENCE TO RELATED APPLICATION

This application claims the benefit of U.S. Provisional Patent Application Ser. No. 60/943,129, filed Jun. 11, 2007, the entirety of which is incorporated by reference herein.

FIELD OF THE INVENTION

This invention is directed generally to tool totes, and more particularly to tool totes configured to support tools.

BACKGROUND

Tool totes have been used to effectively store a tradesman's tools such that the tools are easily accessible. The tool totes have typically been rigid containers formed from resilient materials capable of enduring use in rugged conditions, such as at construction sites and at other locations as well. While rigid tool totes have effectively contained the tools, the rigid tool totes often present storage difficulties because the rigid tool totes are typically nonconforming.

SUMMARY OF THE INVENTION

This invention is directed to a tool tote configured to be self supporting when in use and to be collapsible when stored. The tool tote may include a rigidity enhancement device pivotably attached to a tool tote body within the tool storage compartment and positioned in contact with a bottom wall and two end walls. The rigidity enhancement device may be positioned in contact with the bottom wall and the two end walls to provide enhanced rigidity to the tool tote to prevent walls of the tool tote from collapsing on themselves. The tool tote may be made smaller for storage by pivoting the rigidity enhancement device to be generally aligned with a side wall and collapsing the end walls such that the side walls are moved close together.

In one embodiment, the tool tote body may be formed from a bottom wall, two opposing side walls, and two opposing end walls that are generally orthogonal to the bottom wall and the side walls, which together form a main storage compartment. A rigid handle may extend from an upper portion of one end wall to an upper portion of the other opposing end wall. At least one pocket may extend from an outer surface of one of the two end walls and the two side walls, thereby adding additional storage capacity. In addition, at least one pocket may extend from an inner surface of one of the two end walls and the two side walls. A rigid support member may also be positioned inside of each of the side walls and positioned at an upper edge of the side walls. A rigid support member may also extend vertically between the first and second foldable section of each end wall for providing strength and stability to the end walls.

The tool tote may also include a rigidity enhancement device pivotably attached to the tool tote body and positioned in contact with the bottom wall and the two end walls. In particular, a side edge of the bottom wall portion of the rigidity enhancement device may be pivotably attached to the tool tote at the intersection of the bottom wall and a side wall within the main storage compartment. Each end wall of the rigidity enhancement device may be formed from first and second foldable sections that are positioned adjacent to each other and may include fold lines that extend generally vertically from a bottom edge to a top edge so that the end walls can fold to reduce a width of the tool tote body for storage. The rigidity enhancement device may include a bottom wall section separating two end wall sections. The rigidity enhancement device may also include a releasable connector on a bottom surface of the bottom wall section and on bottom surfaces of the two end wall sections. In one embodiment, the releasable connector may be a hook and loop connector system. The bottom section and side wall sections each include a stiffener to add additional stiffness to the tool tote.

An advantage of the tool tote is that the tool tote may be collapsible such that the internal, tool-containing compartment may be reduced in size for shipping to reduce costs and to reduce storage costs.

Another advantage of the tool tote is that the tool tote is formed from flexible fabric enabling the tool tote to be easily folded from an open, usable position to a folded, storable position.

These and other embodiments are disclosed below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 10:
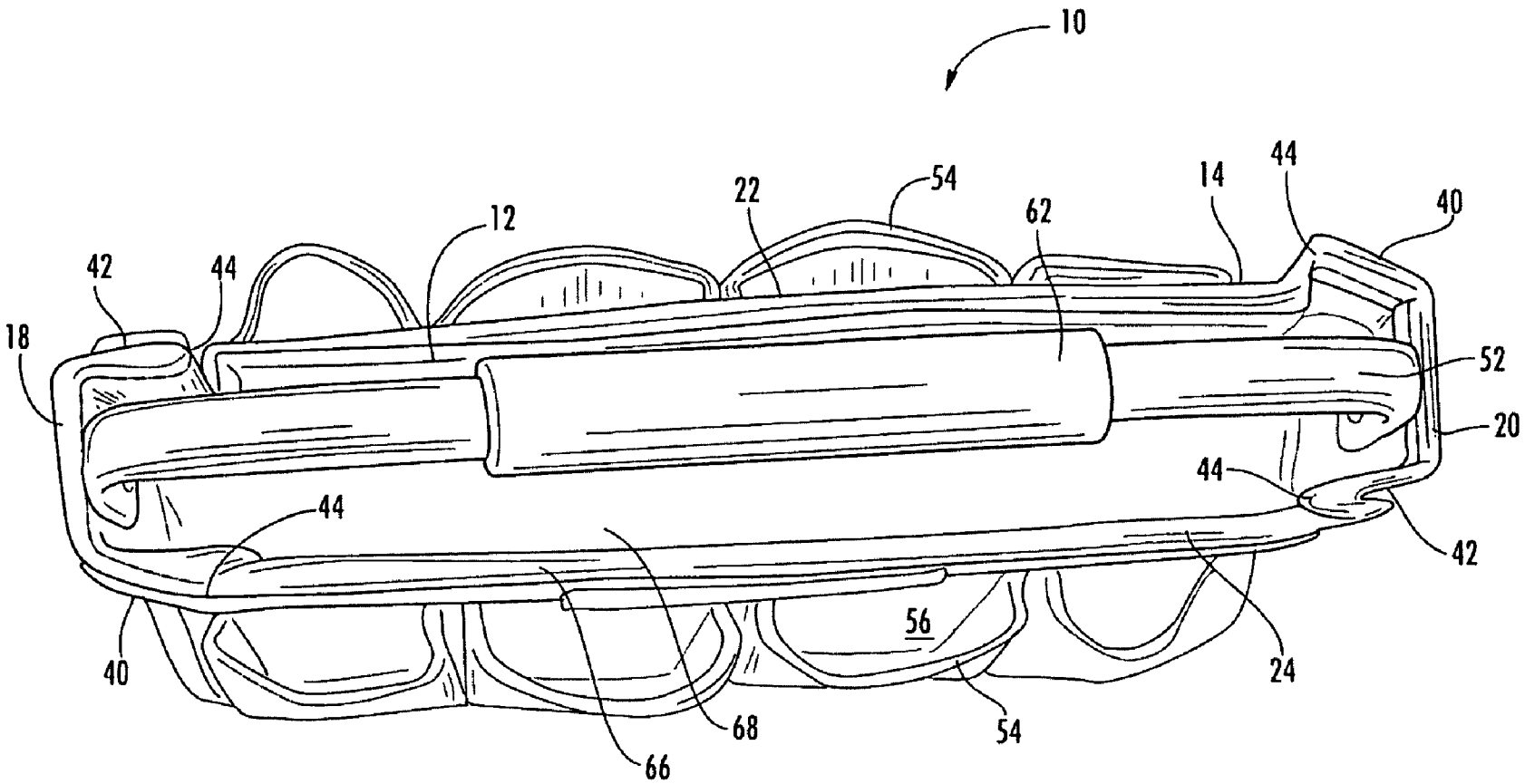
FIG. 10 is a top view of the tool tote in a collapsed position in which the rigidity enhancement device is in a storage position.

As shown in FIGS. 1-10, this invention is directed to a tool tote 10 configured to be self supporting when in use and to be collapsible when stored. The tool tote 10 may include a rigidity enhancement device 12 pivotably attached to a tool tote body 14 and positioned in contact with a bottom wall 16 and two end walls 18, 20. The rigidity enhancement device 12 may be positioned in contact with the bottom wall 16 and the two end walls 18, 20 to provide enhanced rigidity to the tool tote 10 to prevent walls of the tool tote 10 from collapsing on themselves. The tool tote 10 may be made smaller for storage by pivoting the rigidity enhancement device 12 to be generally aligned with a side wall 22, as shown in FIG. 10. In such a portion, the end walls 18, 20 may be folded to reduce the size of the main storage compartment.

Figure 1:
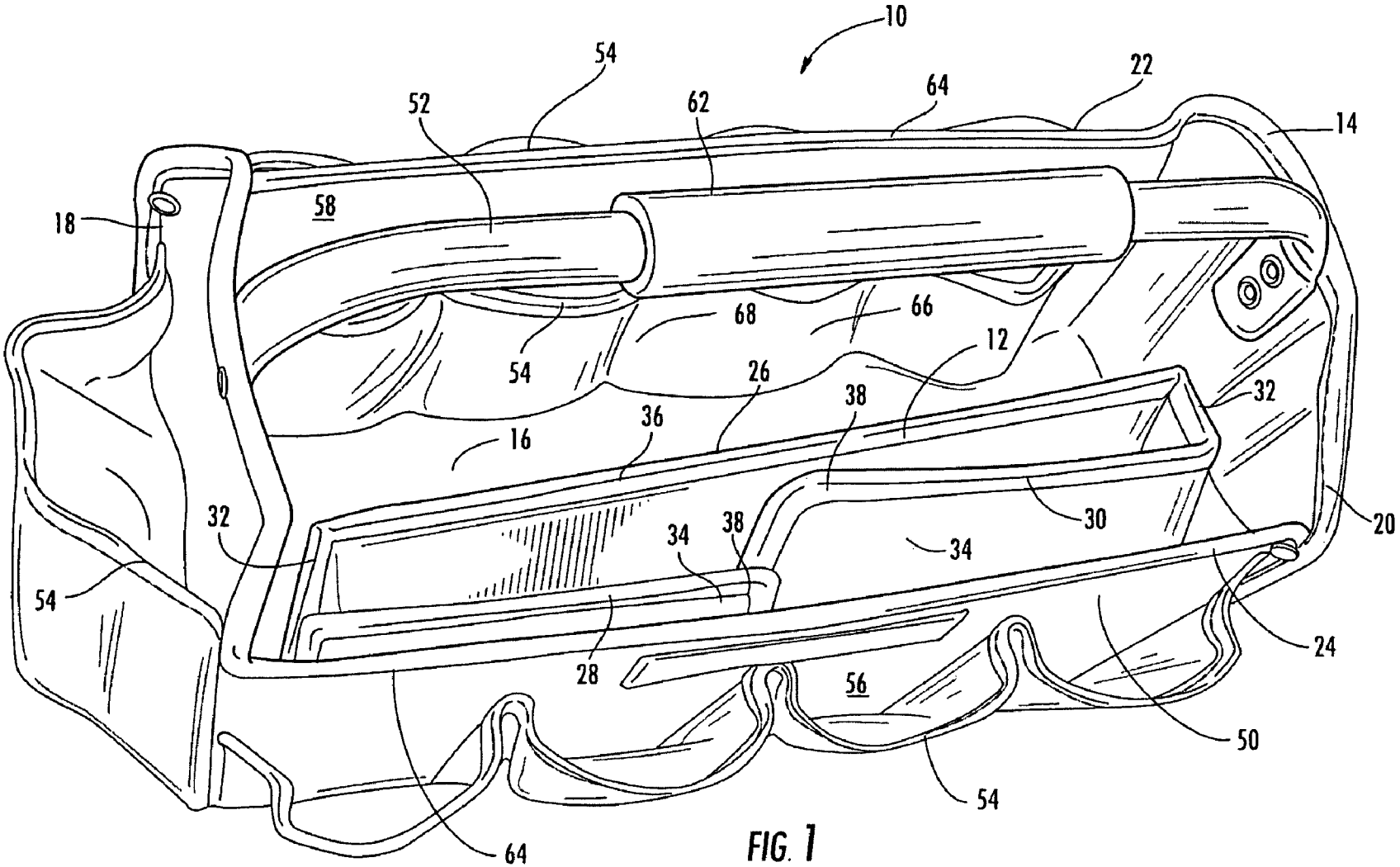
FIG. 1 is a perspective view of a tool tote with a rigidity enhancement device in a folded, storage position.
Figure 2:
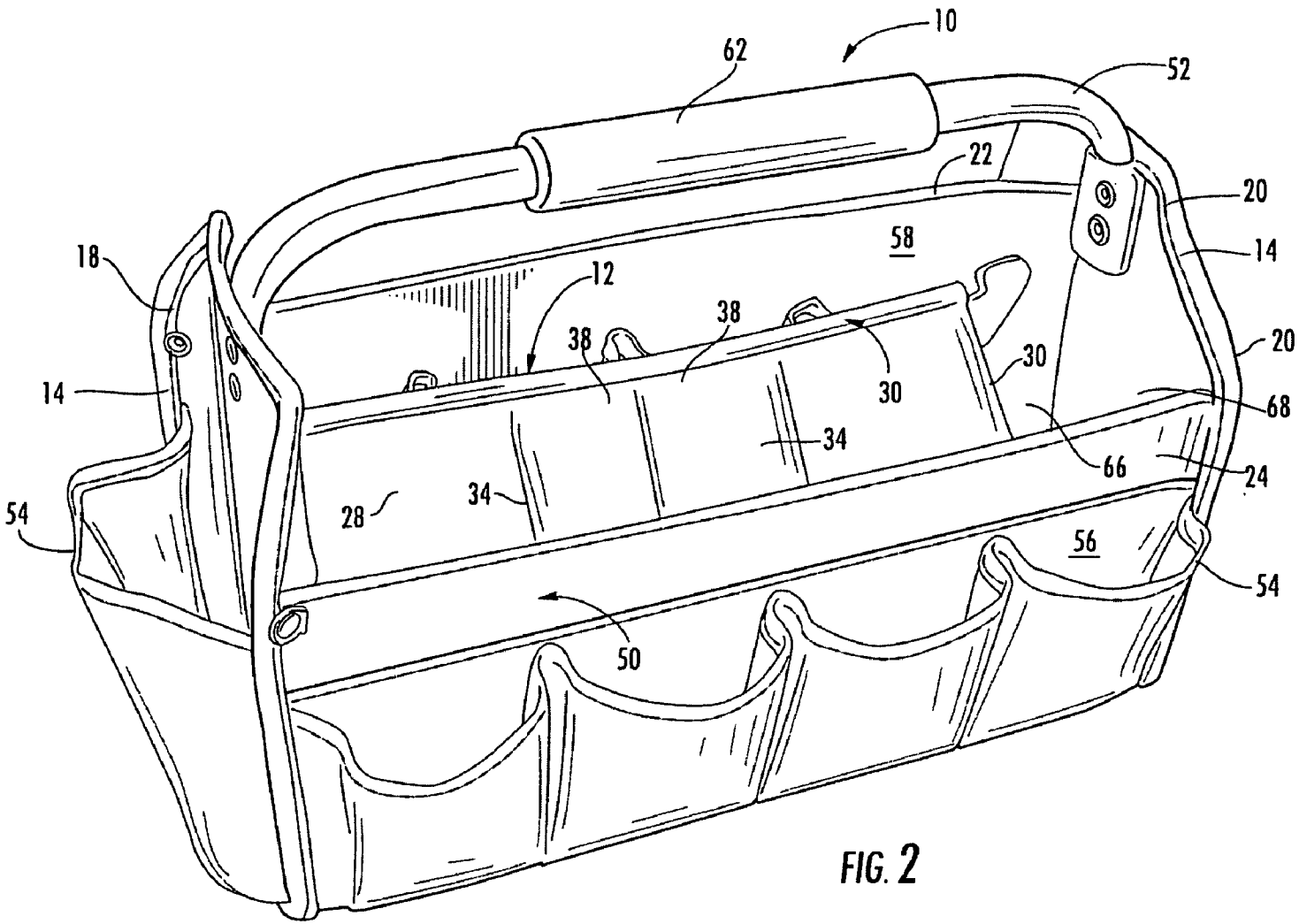
FIG. 2 is a perspective view of the tool tote of FIG. 1 with a rigidity enhancement device as the rigidity device is moved from a folded, storage position to a support position.
Figure 3:
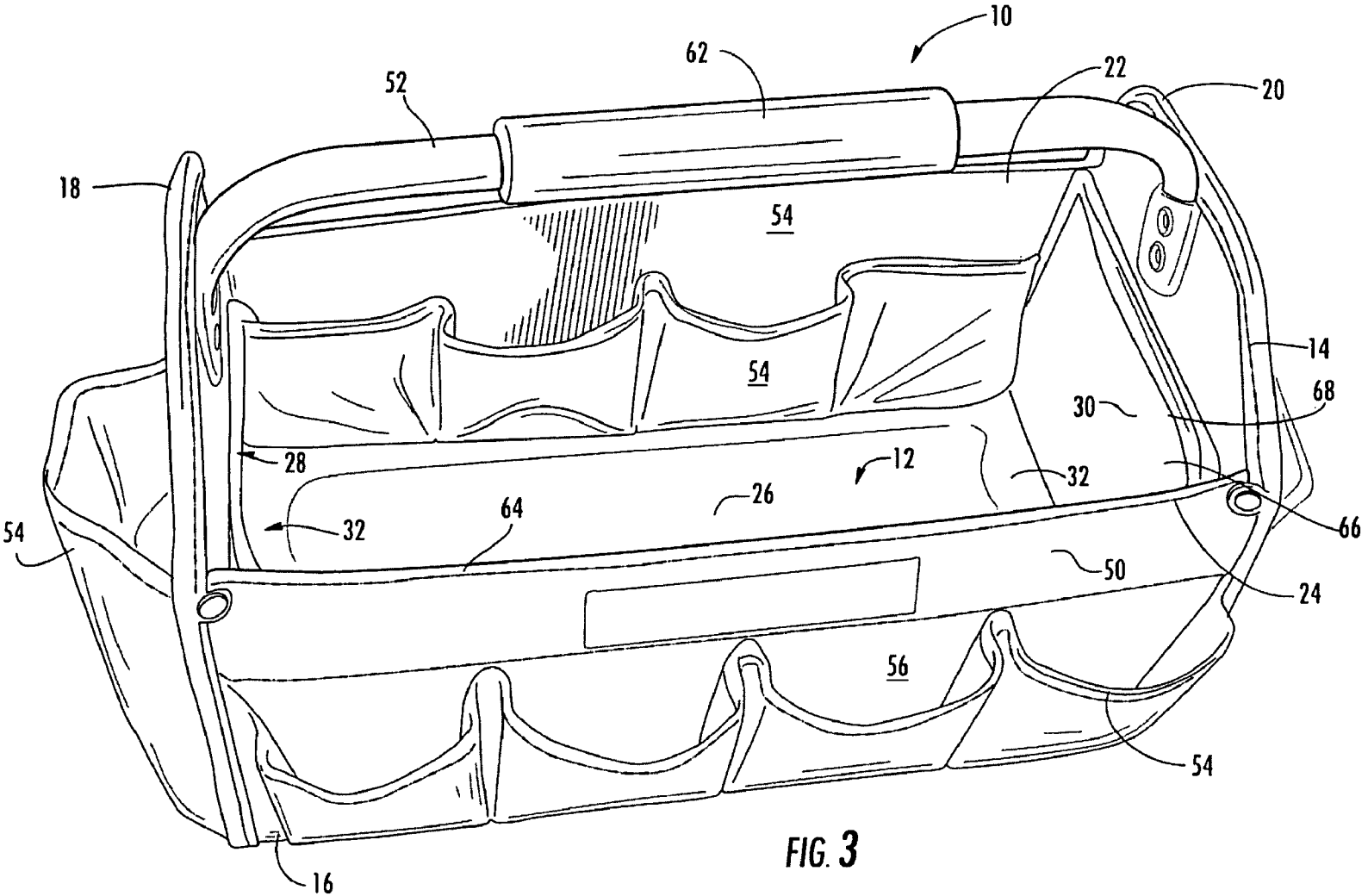
FIG. 3 is a perspective view of the tool tote of FIG. 1 with a rigidity enhancement device in a support position.
Figure 4:
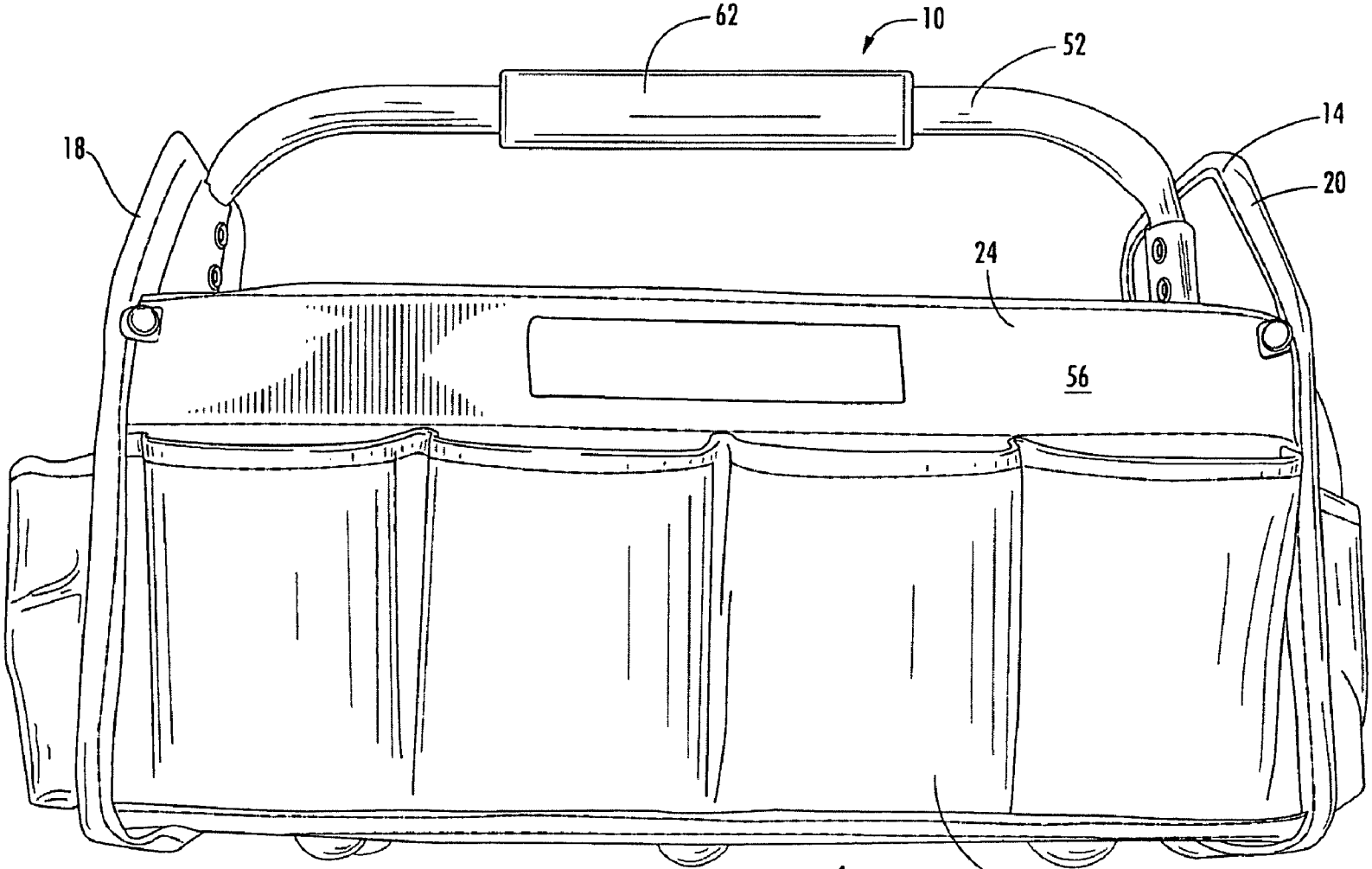
FIG. 4 is a front view of the tool tote.
Figure 5:
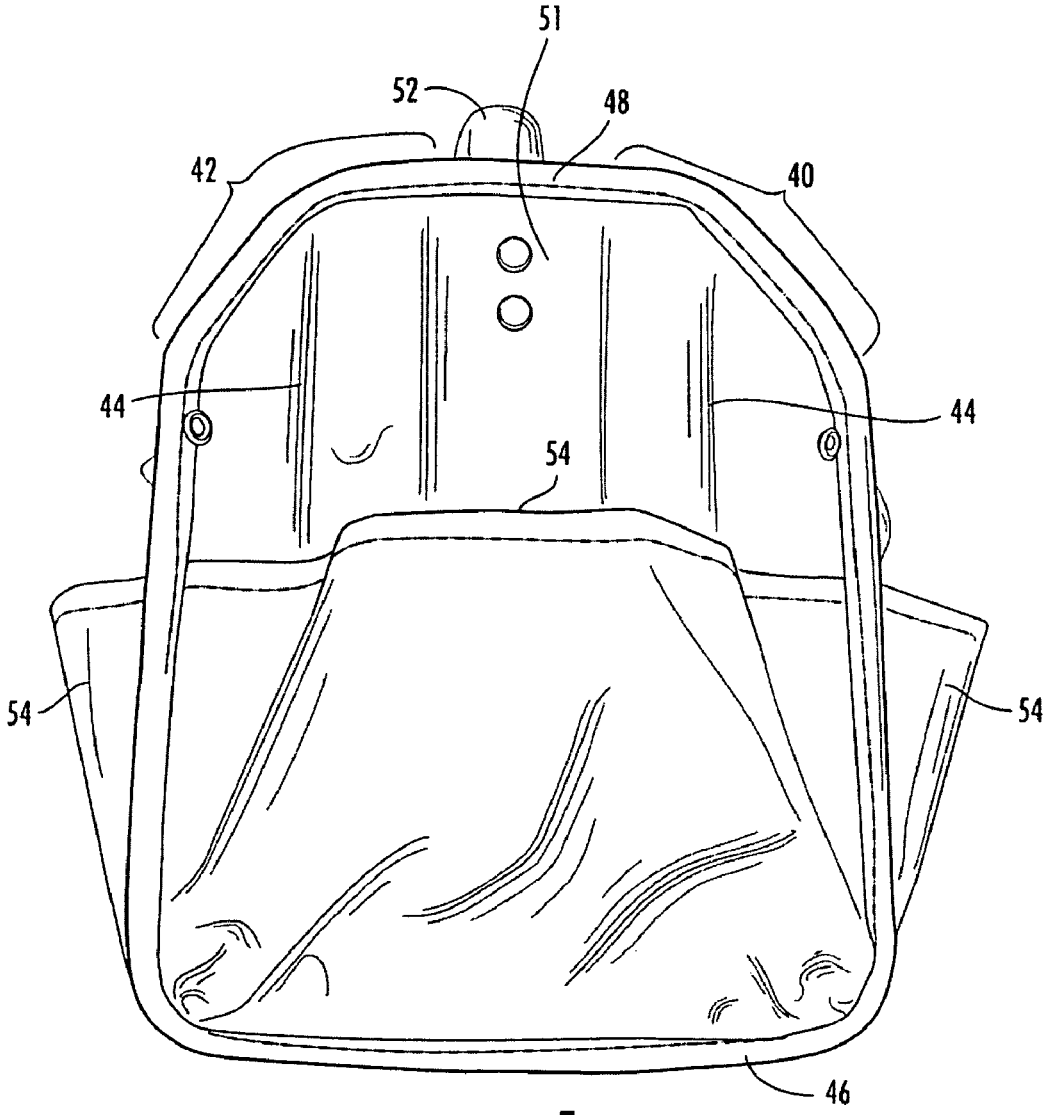
FIG. 5 is a left side view of the tool tote.
Figure 6:
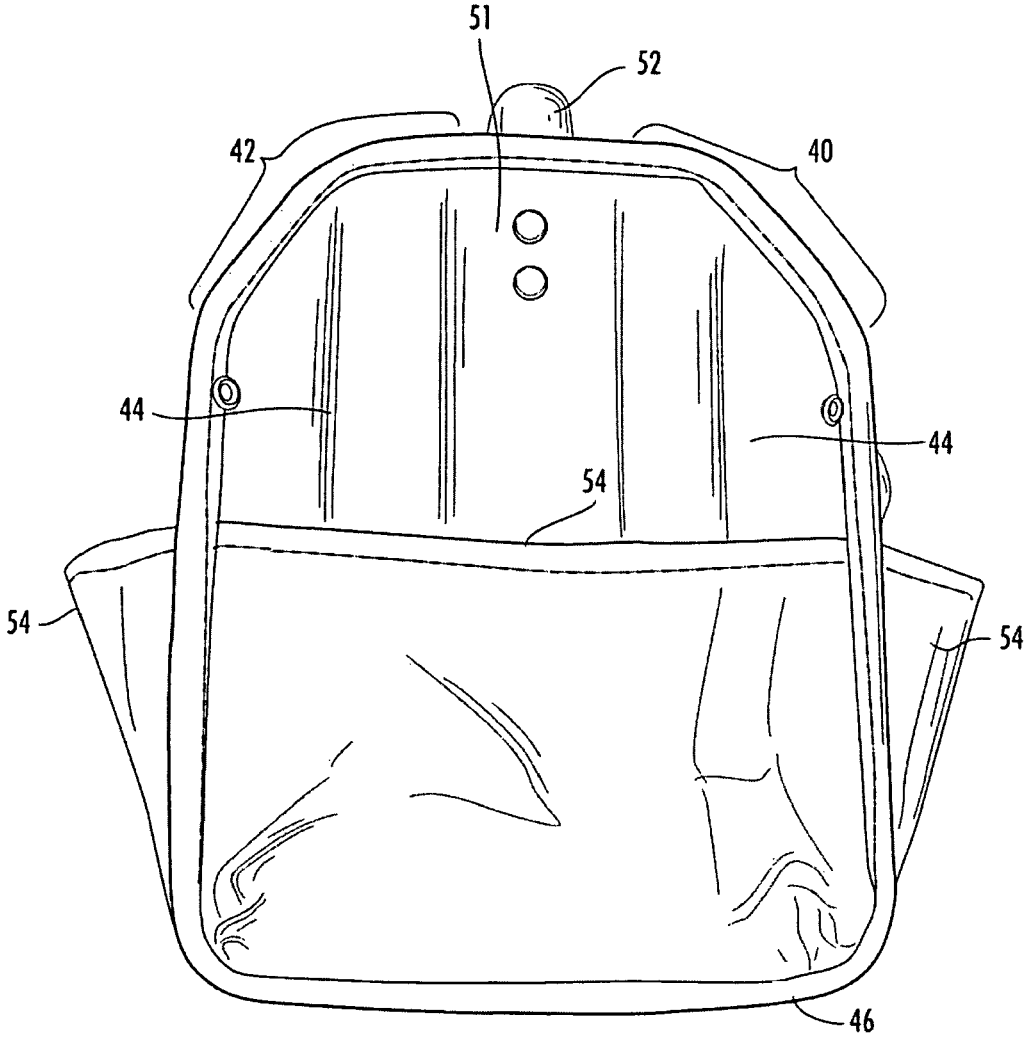
FIG. 6 is a right side view of the tool tote.
Figure 7:
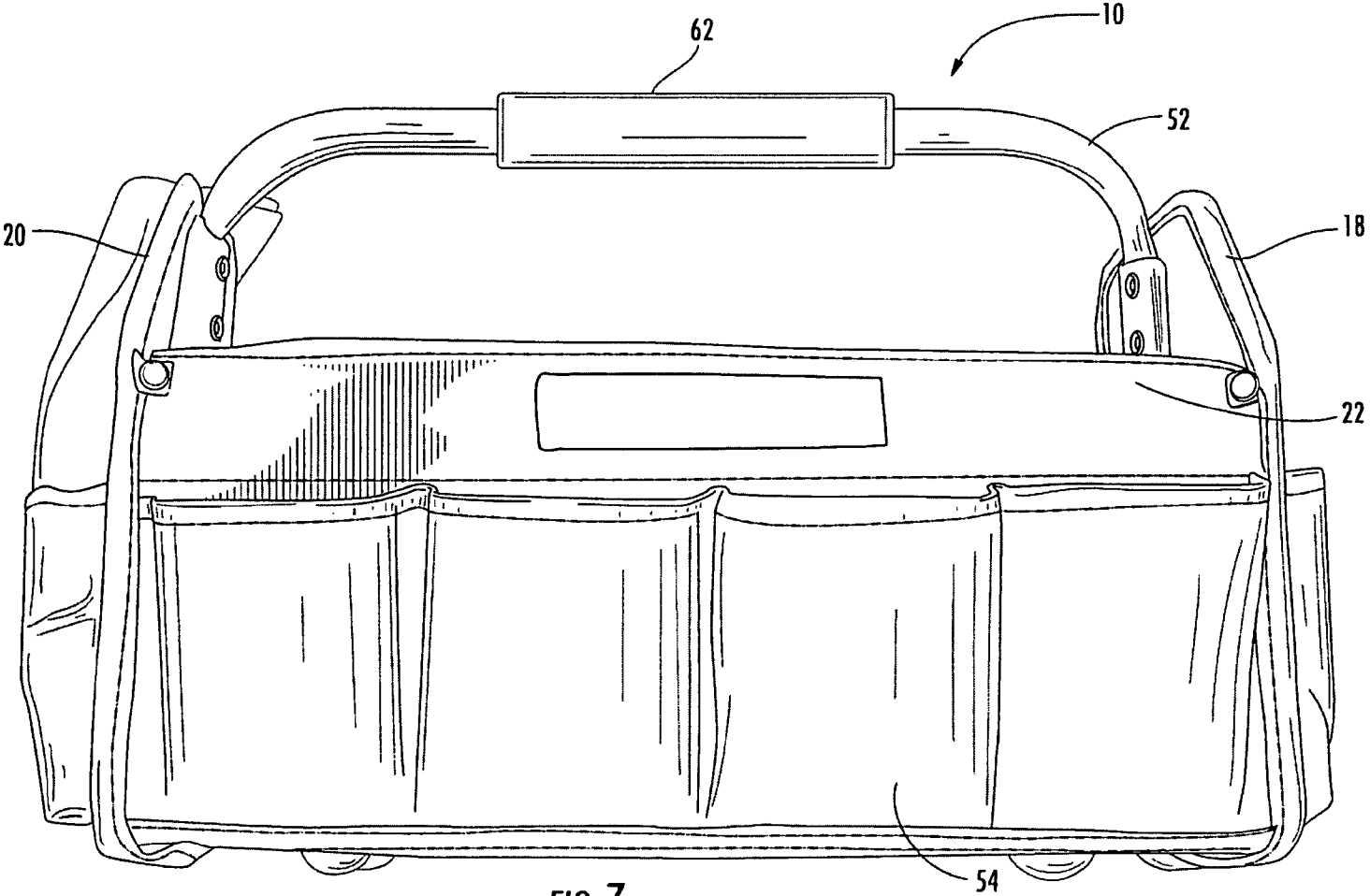
FIG. 7 is a rear view of the tool tote.
Figure 8:
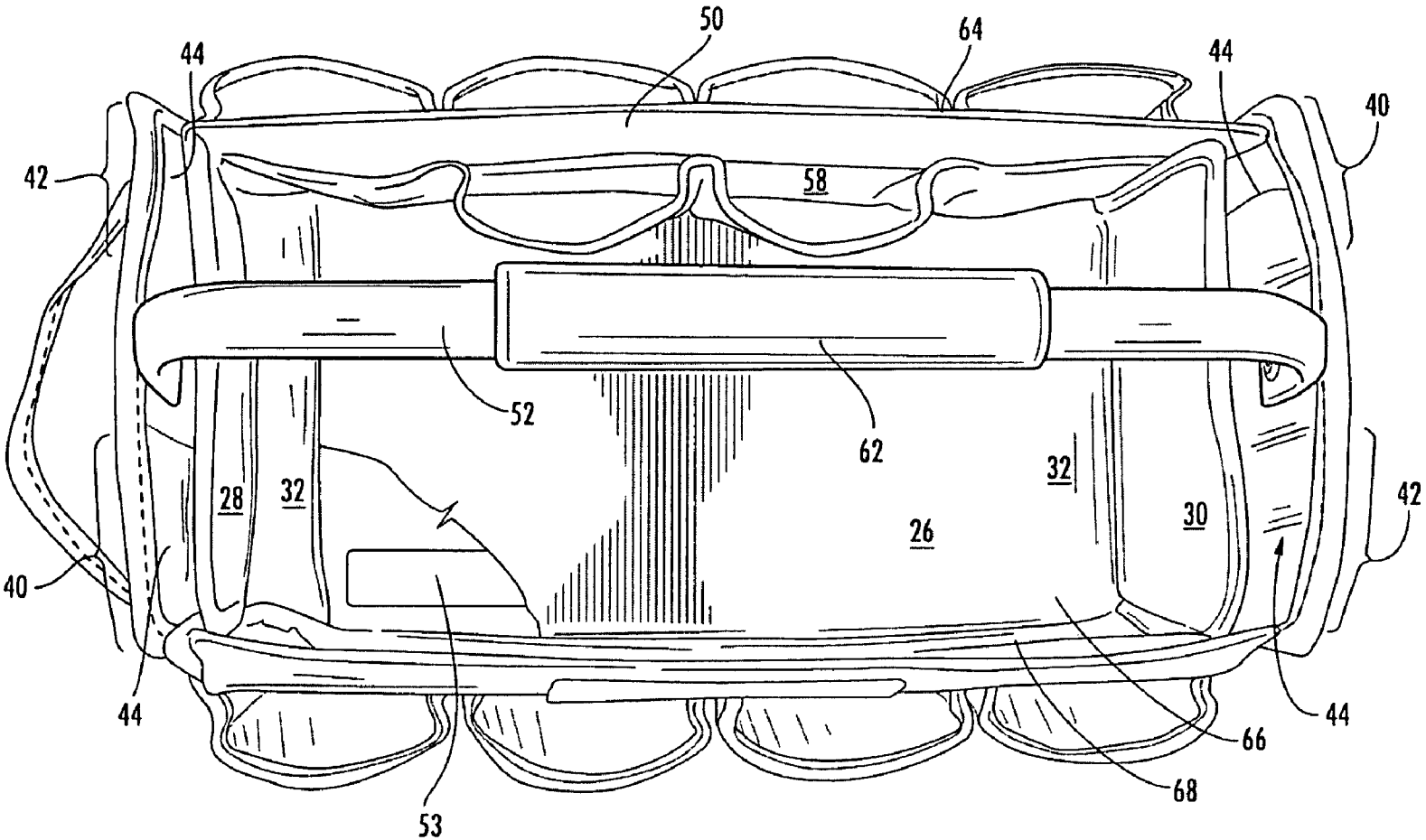
FIG. 8 is a top view of the tool tote with a partial cut-away of the rigidity enhancement device.
Figure 9:
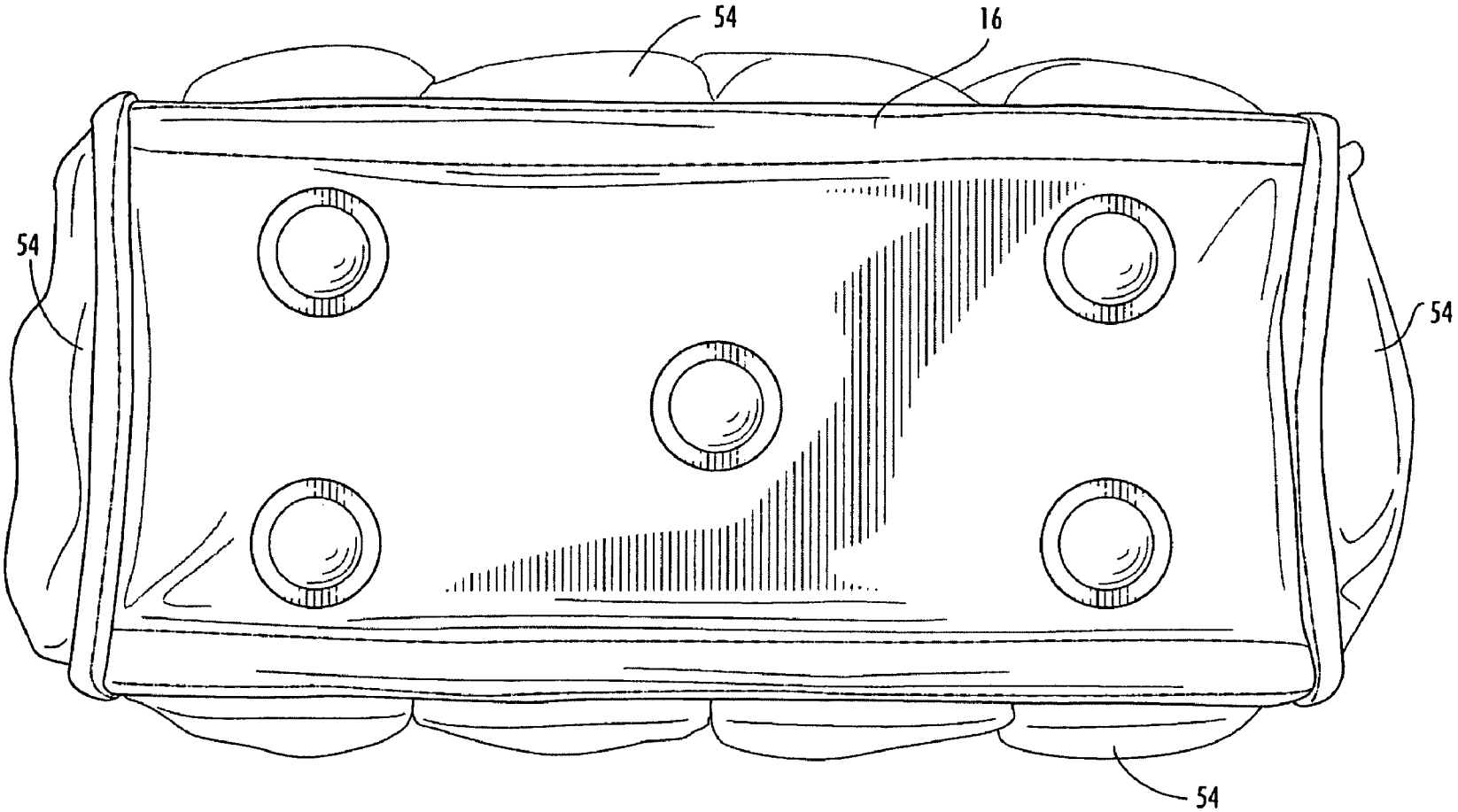
FIG. 9 is a bottom view of the tool tote.

As shown in FIG. 1, the tool tote 10 may be formed from a tool tote body 14 formed from a bottom wall 16, two opposing side walls 22, 24, and two opposing end walls 18, 20 that are generally orthogonal to the bottom wall 16 and the side walls 22, 24. The components forming the tool tote 10 may be formed from fabric covered sheets of a support board, which may be, but is not limited to, a polyethylene (PE) board. The fabric may be a nylon fabric or other appropriate durable fabric configured to endure harsh environments. The rigidity enhancement device 12 may be pivotably attached to the tool tote body 14. The rigidity enhancement device 12 may be pivotably attached at the intersection between one of the side walls 22, 24 and the bottom wall 16. The rigidity enhancement device 12 may be moved between a position in contact with the bottom wall 16 and the two end walls 18, 20, as shown in FIGS. 3 and 8, and a stored position in which the rigidity enhancement device 12 enables the end walls 18, 20 to be collapsed, as shown in FIG. 10. The rigidity enhancement device 12 may include a bottom wall section 26 separating two end wall sections 28, 30. The bottom wall section 26 may be sized to be slightly smaller than the bottom wall 16 of the tool tote body 14. The bottom wall section 26 and the end wall sections 28, 30 may each have stiffeners 53, as shown in FIG. 8, to increase the rigidity of the rigidity enhancement device 12. In one embodiment, the bottom wall section 26 and the end wall sections 28, 30 may each be formed from a flexible fabric pocket containing a semi-rigid polyethylene (PE) board.

In another embodiment, the rigidity enhancement device 12 may include storage collapsible sections 32 between the bottom wall section 26 and each end wall section 28, 30. The storage collapsible sections 32 may be about an inch in length and may extend the width of the bottom wall section 26. The combined length of the bottom wall section 26 and a storage collapsible section 32 at each end may be approximately equal to a length of the bottom wall 16. As such, the bottom wall section 26 and storage collapsible sections 32 may be positioned in contact with the bottom wall 16, and to facilitate easy pivoting, the storage collapsible sections 32 may be pivoted upwardly, thereby enabling the bottom wall section 26 to be pivoted away from the bottom wall 16. The end wall sections 28, 30 may be sized approximately equal to the size of the end walls 18, 20 of the tool tote body 14, though slightly smaller to facilitate moving the end wall sections 28, 30 to a storage position.

In one embodiment, the rigidity enhancement device 12 may include a releasable connector 34 on a bottom surface 36 of the bottom wall section 26 and on bottom surfaces 36 of the two end wall sections 28, 30 for attaching the rigidity enhancement device 12 to the tool tote body 14. The releasable connector 34 may be attached to a portion of the bottom wall section 26, such as on the four corners of the bottom wall section. The releasable connector 34 may also be attached to upper regions 38 of the end wall sections 28, 30. The releasable connector 34 may be a hook and loop connector system or other appropriate connector.

The end walls 18, 20 of the tool tote body 14 may include first and second foldable sections 40, 42 that are positioned adjacent to each other and include fold lines 44 extending generally vertically from a bottom edge 46 to a top edge 48 so that the end walls 18, 20 can fold to reduce a width of the tool tote body 14 for storage. The first and second foldable sections 40, 42 may be separated by a rigid support member 51 extending vertically between the first and second foldable section 40, 42 of each end wall 18, 20 and may be covered by fabric or other material. The first and second foldable sections 40, 42 of the end walls 18, 20 collapse to enable the side walls 22, 24 of the tool tote body 14 to be moved closer together to reduce the volume of the tool tote 10, thereby enabling the tool tote 10 to be shipped and stored more efficiently.

The tool tote 10 may also include a handle 52 extending between the end walls 18, 20. In at least one embodiment, the handle 52 may be formed from a rigid handle extending from an upper portion of one end wall 18 to an upper portion of the other opposing end wall 20. The handle 52 may be formed from metal tubing or other appropriate material. The handle 52 may include a foam grip 62 or other appropriate grip.

The tool tote 10 may also include one or more pockets 54 extending from one or more of an outer surface 56 or an inner surface 58 of the two end walls 18, 20 and the two side walls 22, 24. The pockets 54 may have any appropriate configuration. The size of the pockets 54 may vary based upon the size of the items desired to be placed inside the pockets 54.

The tool tote 10 may also include a rigid support member 50 positioned inside of each of the side walls and positioned at an upper edge 64 of the side walls 22, 24. The rigid support member 50 may be formed from any appropriate material capable of supporting the side walls 22, 24.

During use, the rigidity enhancement device 12 may be moved from a storage position into contact with the bottom wall 16 and the end walls 18, 20. The rigidity enhancement device 12 may be attached to the bottom wall 16 and the end walls 18, 20 with the releasable connectors 34. The rigidity enhancement device 12 may provide support to prevent the side walls 22, 24 from collapsing onto each other. In particular, the rigidity enhancement device 12 may prevent the first and second foldable sections 40, 42 from folding along the fold lines 44. In this condition, the tool tote 10 is capable of remaining open in a generally box like configuration with opening 66 facilitating access to the main storage compartment 68 to store items.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A tool tote, comprising:

a tool tote body formed from a bottom wall, two opposing side walls, and two opposing end walls that are generally orthogonal to the bottom wall and the side walls;

a rigidity enhancement device pivotably attached to the tool tote body, the rigidity enhancement device being movable between a support position in contact with the bottom wall and the two end walls and a stored position in which the rigidity enhancement device enables the end walls to be collapsed, the rigidity enhancement device including a bottom wall section, two end wall sections, and storage collapsible sections between the bottom wall section and each end wall section;

wherein the bottom wall section is pivotably attached to each storage collapsible section and each storage collapsible section is pivotably attached to one of the end wall sections;

wherein a combined length of the bottom wall section and the storage collapsible sections is approximately equal to a length of the bottom wall;

wherein, in the support position, the bottom wall section and the storage collapsible sections are in substantially planar contact with the bottom wall; and wherein each end wall is formed from first and second foldable sections that are positioned adjacent to each other and include fold lines extending generally vertically from a bottom edge to a top edge so that the end walls can fold to reduce a width of the tool tote body for storage.

2. The tool tote of claim 1, further comprising a rigid support member extending vertically between the first and second foldable sections of each end wall.

3. The tool tote of claim 1, further comprising a rigid handle extending from an upper portion of one end wall to an upper portion of the other opposing end wall.

4. The tool tote of claim 1, further comprising at least one pocket extending from an outer surface of one of the two end walls and the two side walls.

5. The tool tote of claim 1, further comprising a rigid support member positioned inside of each of the side walls and positioned at an upper edge of the side walls.

6. The tool tote of claim 1, wherein the rigidity enhancement device further comprises a releasable connector on a bottom surface of the bottom wall section and on bottom surfaces of the two end wall sections.

7. The tool tote of claim 6, wherein the releasable connector is a hook and loop connector system.

8. The tool tote of claim 1, wherein the bottom section and side wall sections each include a stiffener.

9. The tool tote of claim 1, wherein a side edge of the bottom wall section of the rigidity enhancement device is pivotably attached to the tool tote at the intersection of the bottom wall and a side wall.

10. The tool tote of claim 1, further comprising at least one pocket extending from an inner surface of one of the two end walls and the two side walls.

11. A tool tote, comprising:

a tool tote body formed from a bottom wall, two opposing side walls, and two opposing end walls that are generally orthogonal to the bottom wall and the side walls;

a rigidity enhancement device pivotably attached to the tool tote body, the rigidity enhancement device being movable between a support position in contact with the bottom wall and the two end walls and a stored position in which the rigidity enhancement device enables the end walls to be collapsed, wherein the rigidity enhancement device is formed from a bottom wall section, two end wall sections, and storage collapsible sections between the bottom wall section and each end wall section;

wherein the bottom wall section is pivotably attached to each storage collapsible section and each storage collapsible section is pivotably attached to one of the end wall sections;

wherein a combined length of the bottom wall section and the storage collapsible sections is approximately equal to a length of the bottom wall;

wherein, in the support position, the bottom wall section and the storage collapsible sections are in substantially planar contact with the bottom wall;

wherein each end wall is formed from first and second foldable sections that are positioned adjacent to each other and include fold lines extending generally vertically from a bottom edge to a top edge so that the end walls can fold to reduce a width of the tool tote body for storage; and a rigid support member extending vertically between the first and second foldable section of each end wall.

12. The tool tote of claim 11, further comprising a rigid handle extending from an upper portion of one end wall to an upper portion of the other opposing end wall.

13. The tool tote of claim 11, further comprising at least one pocket extending from an outer surface of one of the two end walls and the two side walls.

14. The tool tote of claim 11, further comprising a rigid support member positioned inside of each of the side walls and positioned at an upper edge of the side walls.

15. The tool tote of claim 11, wherein the rigidity enhancement device further comprises a releasable connector on a bottom surface of the bottom wall section and on bottom surfaces of the two end wall sections.

16. The tool tote of claim 15, wherein the releasable connector is a hook and loop connector system.

17. The tool tote of claim 11, wherein the bottom section and side wall sections each include a stiffener.

18. The tool tote of claim 11, wherein a side edge of the bottom wall section of the rigidity enhancement device is pivotably attached to the tool tote at the intersection of the bottom wall and a side wall.

19. The tool tote of claim 11, further comprising at least one pocket extending from an inner surface of one of the two end walls and the two side walls.

* * * * *